US010556643B2

(12) United States Patent
Carlisle

(10) Patent No.: US 10,556,643 B2
(45) Date of Patent: Feb. 11, 2020

(54) BOAT PONTOON

(71) Applicant: James Carlisle, Lexington, SC (US)

(72) Inventor: James Carlisle, Lexington, SC (US)

( * ) Notice: Subject to any disclaimer, the term of this patent is extended or adjusted under 35 U.S.C. 154(b) by 0 days.

(21) Appl. No.: 15/816,292

(22) Filed: Nov. 17, 2017

(65) Prior Publication Data

US 2019/0152562 A1 May 23, 2019

(51) Int. Cl.

| | |
|---|---|
| ***B63B 35/44*** | (2006.01) |
| ***B63B 1/20*** | (2006.01) |
| ***B63B 35/34*** | (2006.01) |
| ***B63B 1/12*** | (2006.01) |
| ***B63B 3/56*** | (2006.01) |

(52) U.S. Cl.

CPC ..... *B63B 1/20* (2013.01); *B63B 1/121* (2013.01); *B63B 3/56* (2013.01); *B63B 35/34* (2013.01); *B63B 2001/204* (2013.01); *B63B 2001/205* (2013.01)

(58) Field of Classification Search

CPC ..... B63B 1/20; B63B 35/34; B63B 2001/204
USPC ..... 114/292
See application file for complete search history.

(56) References Cited

U.S. PATENT DOCUMENTS

| | | | | | |
|---|---|---|---|---|---|
| 2,670,159 | A * | 2/1954 | Barr | B64C 25/66 | 244/101 |
| 3,632,069 | A * | 1/1972 | Thayer | F16L 3/233 | 248/56 |
| 4,356,787 | A * | 11/1982 | Harley | B63B 1/20 | 114/292 |
| RE33,359 | E * | 10/1990 | Lang | B63B 1/12 | 114/283 |
| 5,184,561 | A | 2/1993 | Nickell, Jr. | | |
| 5,784,977 | A | 7/1998 | Schell et al. | | |
| 5,911,187 | A | 6/1999 | Sohm | | |
| 6,067,923 | A * | 5/2000 | Ratlieff, Jr. | B63B 1/042 | 114/289 |
| 6,516,736 | B1 | 2/2003 | Lancker | | |
| 7,410,400 | B2 * | 8/2008 | Staudinger | B63B 1/14 | 114/123 |
| 7,739,975 | B1 * | 6/2010 | Manderfeld | B63B 3/12 | 114/292 |
| 7,798,088 | B2 | 9/2010 | Hoover et al. | | |
| 7,827,926 | B2 | 11/2010 | Payne | | |
| 7,950,340 | B1 | 5/2011 | Curtis | | |
| 9,676,450 | B1 | 6/2017 | Brignolio | | |
| 2009/0293790 | A1 * | 12/2009 | Bogard | B63B 1/20 | 114/61.2 |

* cited by examiner

*Primary Examiner* — Daniel V Venne
(74) *Attorney, Agent, or Firm* — Southeast IP Group, LLC; Thomas L. Moses

(57) ABSTRACT

A boat pontoon having a concave V-shape on a bottom portion thereof, generally straight vertical sides, a flat top panel member, and a removable and replaceable skid pad running longitudinally along the bottom of the pontoon. Vertically oriented gussets are positioned on an interior of the pontoon, to provide structural integrity and additional strength. In a preferred embodiment, a buoyant foam is provided within the interior cavity of the pontoon.

8 Claims, 6 Drawing Sheets

BOAT PONTOON

FIELD OF THE INVENTION

The present invention relates to pontoons used for boats and other watercraft. More specifically, the present invention relates to pontoons having aqua-dynamic shapes to improve the speed, performance and stability of watercraft.

BACKGROUND OF THE INVENTION

Pontoon boats have become popular among boating enthusiasts in recent years due to their stability, durability, seating capacity and comfort. Similarly to automobiles, pontoon boats are increasing in size and are being developed with more features and creature comforts. In recent years, pontoon boat manufacturers have begun placing fiberglass structures around the periphery of the platform, which provide more modern appearance, and which house the seating and storage compartments, the helm, and other parts of the upper structure. The addition of fiberglass allows the boats to have more aerodynamic shapes, but also adds a significant amount of weight to the boats. In order to compensate for the additional weight, pontoon boat manufacturers have begun increasing the size of motors, both inboard and mostly outboard, so that the pontoon boats can get up on plane and travel at faster speeds.

One issue with pontoon boats of the past is that the shape of the pontoons has traditionally included a generally round cross section, which is not a particularly advantageous shape for performance characteristics, as the motors have to provide significant output and torque to get a heavy pontoon boat with round pontoons to get up and run on plane.

Various efforts to produce pontoons having a more aqua-dynamic shape have been made to improve the performance of the pontoons, and reduce drag that the pontoons produce in the water while the boat is underway. The following are examples of pontoons that have been developed to improve the performance and speed characteristics of pontoon boats, and each of the references cited below are hereby incorporated by reference herein:

U.S. Pat. No. 5,184,561—Planing Pontoon Boat

A pontoon boat comprising elongated flotation units of generally circular cross-section positioned in spaced-apart parallel relationship with each of the flotation units having planing fins extending longitudinally of the inboard and outboard sides of the flotation units near the bottom thereof to cause the pontoon boat to readily hydroplane. A wedge-shaped fin is provided on the underside of the outboard planing fins near the bow section to provide additional lift when turning at high speeds to improve control and stability on turns.

U.S. Pat. No. 5,784,977—Pontoon for Watercraft

An improved, planning pontoon boat has first and second spaced apart, elongated pontoons which exhibit a bow end and a stern end relative to the boat. A lower surface of each of the pontoons exhibits two intersecting planar members which terminate adjacent to respective elongated lift pads for the purpose of providing improved planing characteristics for the pontoons. The lift pads are each formed of intersecting concave surfaces. The lift pads extend radially from the pontoons and are located adjacent to the intersection of the planar surfaces and an upper curved surface of the pontoon. An elongated keel extends along the bottom of each of the pontoons, in the region where the planar elements intersect. The keel extends parallel to the lift pads.

U.S. Pat. No. 5,911,187—Pontoon

A pontoon boat having a deck disposed over distal, watertight pontoons. Each pontoon comprises an elongated, generally cylindrical shell having a bow end consisting of an eccentric conical section extending upward at an angle out of the water. Splash rails, comprising fins protruding from the pontoon's shell, are disposed along the pontoon's inner and outer surfaces so that they extend substantially from the pontoon's bow end to its stern end. Each pontoon may also includes a splash guard comprising a second, larger fin mounted to the inner surface of the pontoon's shell near the its bow end. The deck of the pontoon boat includes a motor transom for mounting an outboard motor.

U.S. Pat. No. 6,516,736—Pontoon Watercraft and Method for Making Same

A pontoon for floating a watercraft, wherein the pontoon has a skin forming a closed body, a foam coupled to the skin within the closed body, and integral features formed by the skin. The integral features may include a support structure for mounting a watercraft structure.

U.S. Pat. No. 7,798,088—Planing Pontoon Tube

An improved water tight, chambered planing pontoon assembly incorporates a hollow shell with a cross sectional shape in the form of an upper portion and lower portion. The upper portion of the shape is generally semi-cylindrical extending downward and terminates with opposing chines extending the full length of the tube. The lower portion of the shape is formed by equal and opposing planing surfaces which extend upward at acute angles from a vertical center line, then turn outward, perpendicular to the vertical center line, meeting at the chines. The tube terminates on the bow end with an elongate semi-cone and on the opposite end with a water tight bulkhead. The upper and lower portions of the tube are formed of one homogeneous sheet of metal. The semi-cone with opposing chine portions is formed of one homogeneous sheet of metal.

U.S. Pat. No. 7,827,926—Profiled Pontoon for Watercraft

A pontoon for a watercraft. The pontoon has a vertical inboard side and a generally angled bottom defined by the inboard side height of the pontoon being greater than its outboard side height. The bottom has planing surfaces that define one or more channels, which produce lift upon the watercraft increasing its speed on water. An inboard horizontal planing surface allows relatively low speed planing.

U.S. Pat. No. 7,950,340—Pontoon

A pontoon boat having enhanced handling characteristics includes a deck, a central pontoon mounted to said deck, two outer pontoons mounted to said deck on respective opposite sides of said central pontoon, and a motor, wherein the central pontoon extends below the outer pontoons to create a V-shaped hull, and the motor is capable of causing said center and outer pontoons to plane during normal operation.

U.S. Pat. No. 9,676,450-Pontoon Structure for Supporting a Boat Body

Pontoon structure for a boat includes an elongated pontoon with a bottom forming a water entrapment channel between a front end portion and a rear end portion of the pontoon, the bottom configuration causing the pontoon and the supported boat body to quickly rise above the water surface and plane.

U.S. Patent Application Publication No. 20090293790—Pontoon with Integrated Lifting Strake and Method for Making the Same A pontoon with an improved running surface and methods for construction the same are provided. The pontoon comprises an interior concave main running surface formed along the longitudinal centerline of the pontoon which is bounded by two sponsons, which in turn are bounded by two distal concave surfaces, or integrated lifting strakes. The associated methods provide a process for retrofitting prior art pontoons or constructing the pontoon to avoid the need for welds below the waterline of the pontoon. The pontoon provides improved pontoon boat performance by maximizing lift and minimizing leakage. The pontoon also reduces construction costs by lowering the number of welds required to form a pontoon with lifting strakes.

Each of the above-referenced pontoon structures includes various disadvantages, including expense of manufacture, some are unnecessarily complicated, and some simply do not perform as advertised. Therefore, it would be advantageous to provide a novel pontoon that is easy and inexpensive to manufacture, which has a simple construction, and which improves the performance and speed characteristics of a watercraft bearing such a pontoon.

BRIEF SUMMARY OF THE INVENTION

In accordance with one aspect of the invention, a first embodiment of an improved pontoon is designed with a bottom portion having a concave V-shape, generally straight vertical side walls, and a flat top panel. The pontoon may be manufactured in sections, and the sections may be attached to one another through welding (or any other suitable method).

In order to provide support and strength to the pontoons, different types of gussets are used. A seam gusset has the same general shape as the cross-section of the pontoon, with the concave V-shape on a bottom portion thereof, generally straight vertical sides, and a flat top. The seam gussets are preferably used at both ends of a section of the pontoon, so that a seam gusset is positioned adjacent a seam in the pontoon, when the pontoon is manufactured in shorter sections that are affixed to one another. A second type of gusset, the support gusset, has a similar shape, but the support gusset does not reach all the way to the top of the pontoon, which provides an opening between the top of the support gusset and the flat top panel. Preferably, both the seam gusset and the support gusset also include or define a series of holes.

In a preferred embodiment, the front portion of the pontoon has a rear portion that complements the shape of the pontoon, as described above, and which narrows and rises going forward to a point at the top of the pontoon, similarly to the shape of the bow of a V-hull fiberglass boat. Additionally, in a preferred embodiment, a removable skid pad may be attached to the bottom of the pontoon, in order to protect the pontoon when the boat is beached, or hits rocks or other subsurface structures. If the skid pad is damage, it may simply be removed and replaced by a new one.

In another embodiment, the concave V-shape on the bottom portion of the pontoon extends from a front of the pontoon to a point toward the rear of the pontoon, and then is stepped out to form a U-shape on the bottom portion near the rear of the pontoon. In this embodiment, the rear U-shaped portion of the pontoon on an underside resembles a traditional pontoon, and preferably extends from the rear of the pontoon through the rear ⅓ to ½ of the pontoon, although the rear U-shaped portion may extend throughout more or less of the pontoon, as desired.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Overview

Figure 2:
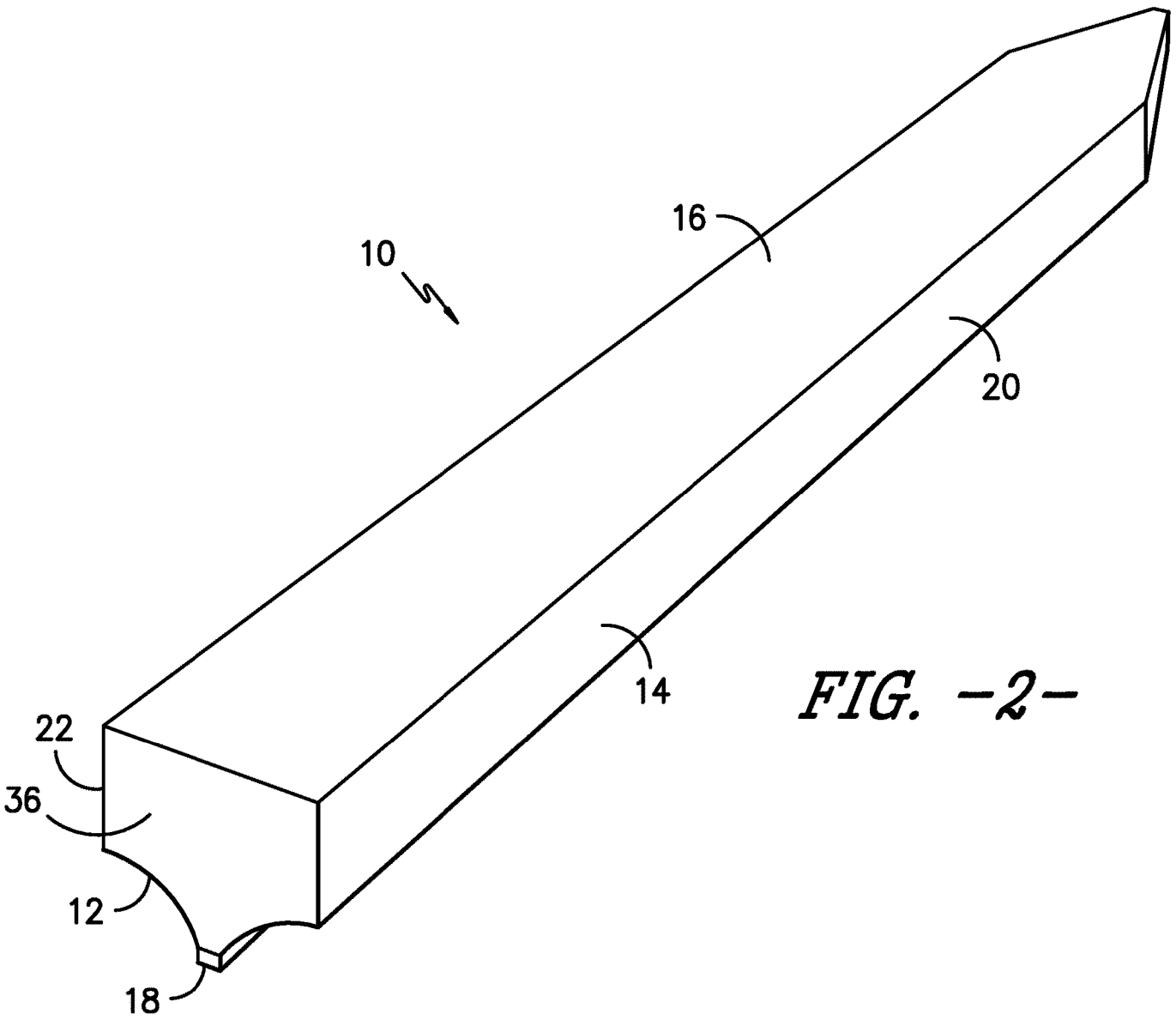
FIG. 2 is a perspective view of one embodiment of a boat pontoon in accordance with one aspect of the present invention.
Figure 3:
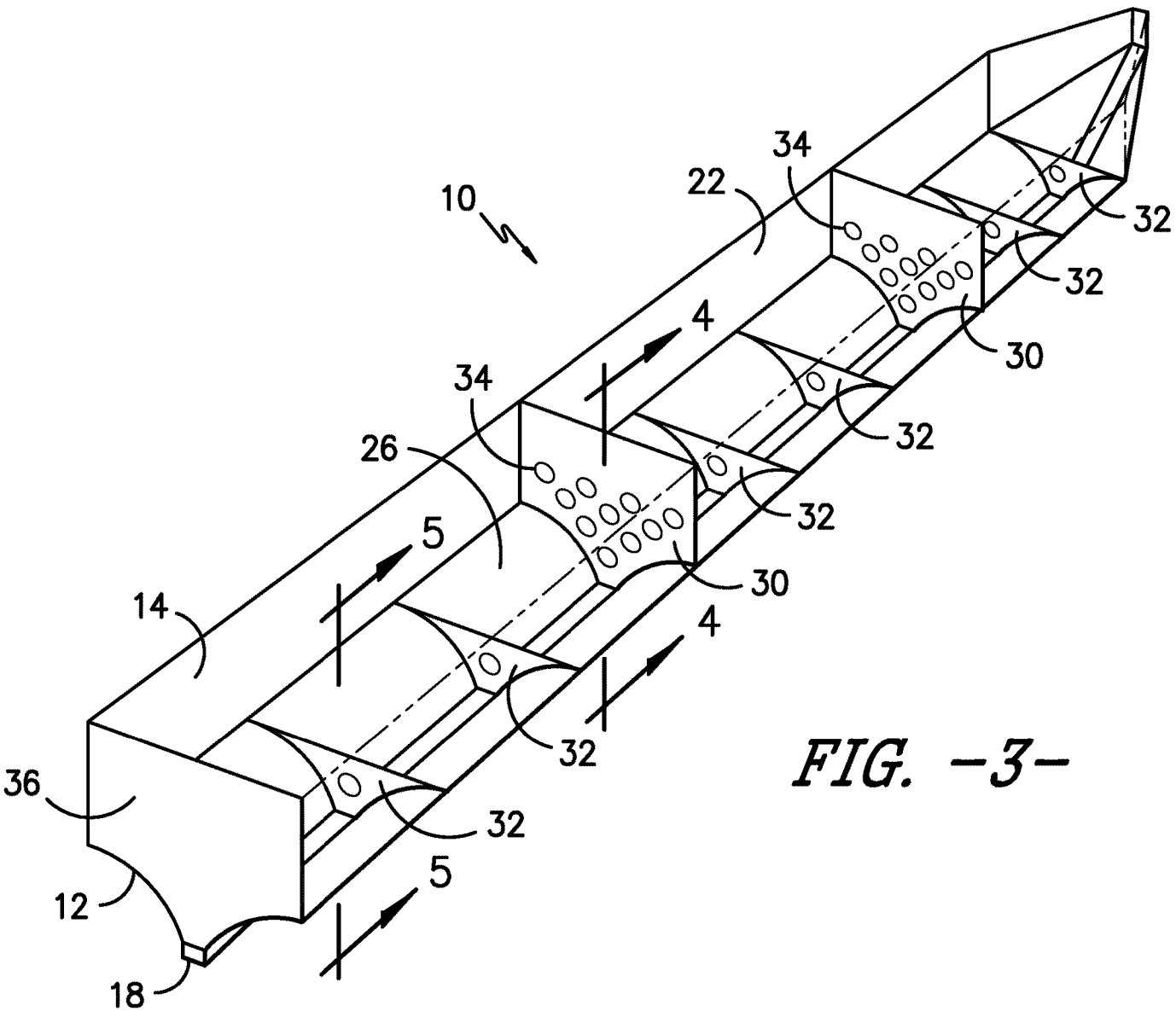
FIG. 3 is a perspective cutaway view of one embodiment of a boat pontoon having a concave V-shape on a bottom portion thereof, and further including intermittently spaced seam gussets and support gussets positioned in a vertical orientation.
Figure 4:
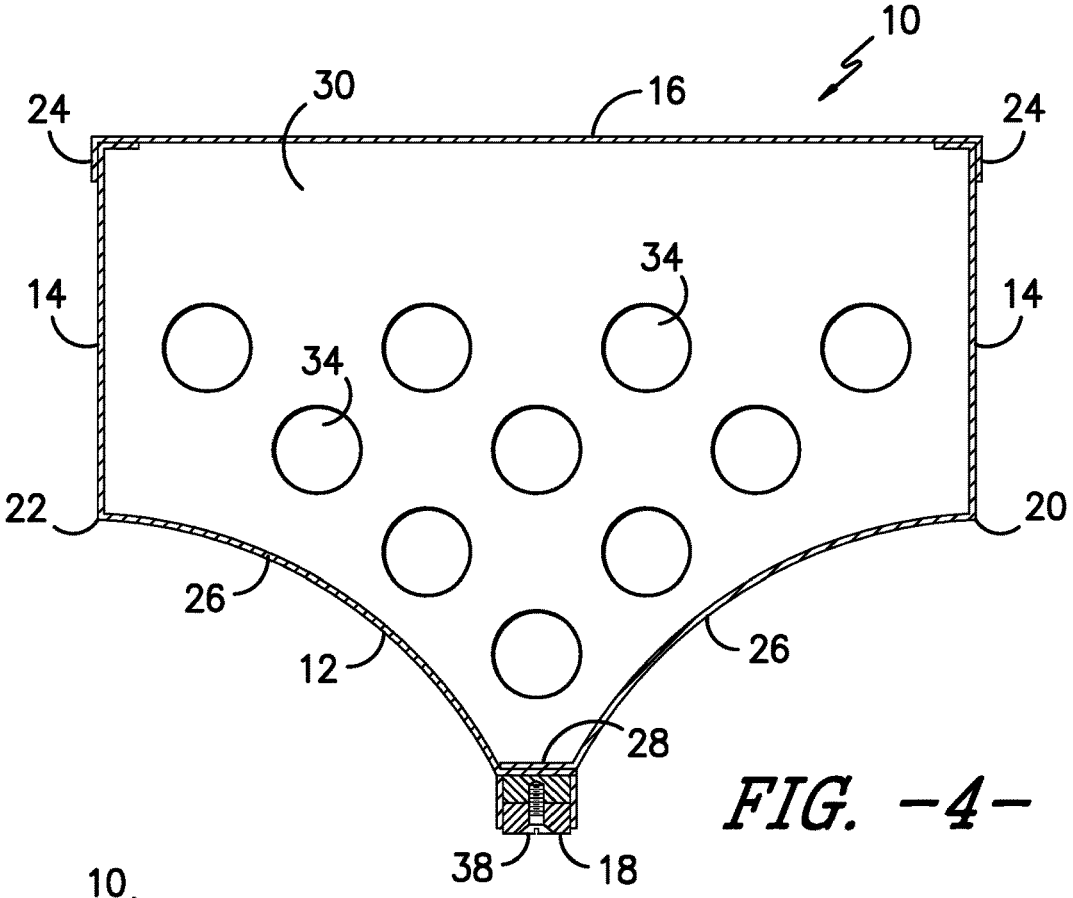
FIG. 4 is a cross-sectional view along the line 4-4 of FIG. 3, illustrating one embodiment of a boat pontoon having a concave V-shape on a bottom portion thereof, and further including a seam gusset defining a series of holes therein and a detachable skid plate on an underside of the pontoon.
Figure 5:
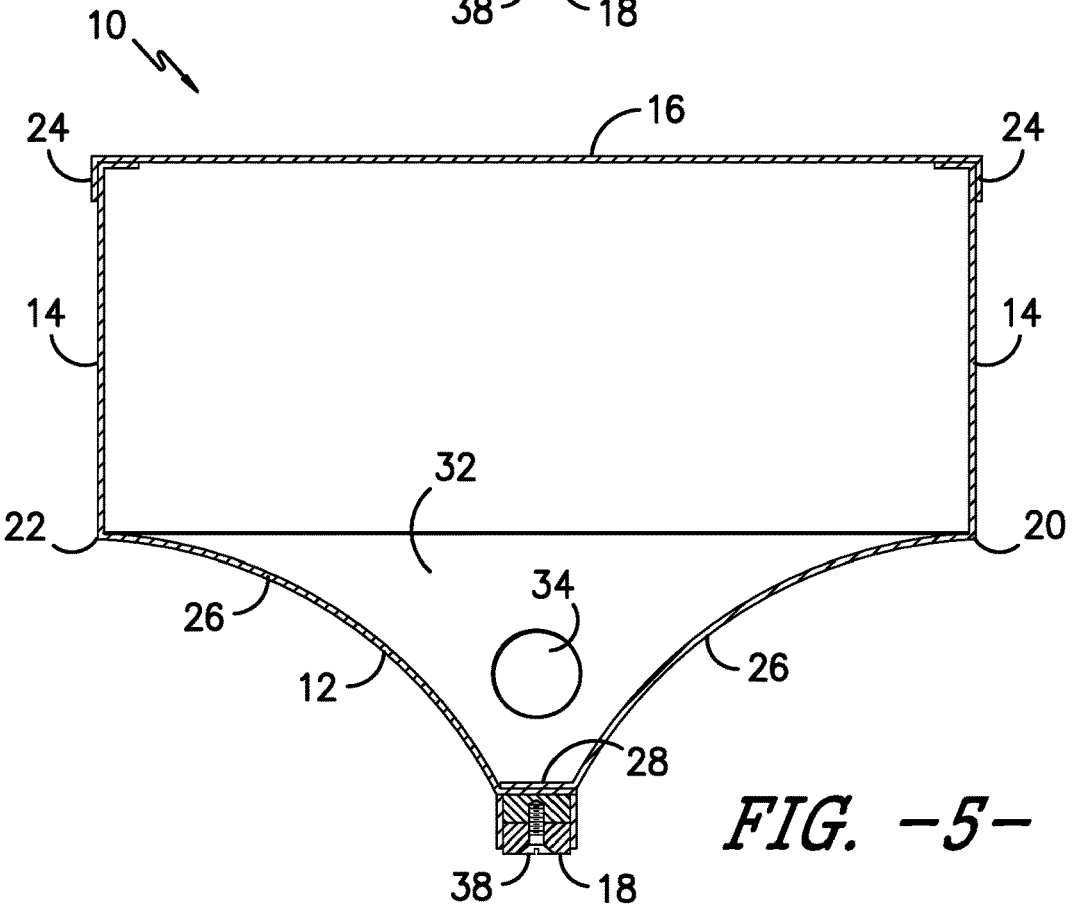
FIG. 5 is a cross-sectional view along the line 5-5 of FIG. 3 illustrating one embodiment of a boat pontoon having a concave V-shape on a bottom portion thereof, and further including a support gusset and a detachable skid plate on an underside of the pontoon.

The present invention includes, in a first embodiment, a pontoon 10 having a concave V-shape 12 on a bottom portion thereof, generally straight vertical sides 14, a flat top panel member 16, and a removable skid pad 18 running longitudinally along the bottom of the pontoon 10, as shown in FIGS. 1-6. The pontoon 10 may be manufactured in sections, and each section preferably includes a right side member 20, a left side member 22 and a flat top panel 16. The top panel 16 is a longitudinally extending flat surface, and includes a lip 24 extending downwardly on either side. The right side member 20 includes a generally straight vertical side section 14, a curved lower portion 26, and a horizontal bottom lip 28, as shown in FIGS. 4 and 5. The left side member 22 is essentially a mirror image of the right side member 20, also including a generally straight vertical side section 14, a curved lower portion 26, and a horizontal bottom lip 28.

When the right side member 20 and the left side member 22 are assembled together, the horizontal lips 28 are adapted to stack one on top of the other, as shown, so that they can be welded or otherwise attached together, and so that the bottom portion of the pontoon 10 includes a double layer of material (preferably aluminum or other metal). The flat top panel 16 is placed over the top edge of the right and left side members 20, 22, and the lip 24 on either side of the flat top panel 16 extends downwardly on the outer sides of the generally straight side walls 14 of the right and left side members 20, 22, as shown. Preferably, all of the seams are welded, although it is contemplated that other attachment means may be used.

In order to provide support and strength to the pontoons 10, different types of gussets are used. A seam gusset 30 has the same general shape as the cross-section of the pontoon 10, with the concave V-shape on a bottom portion thereof, generally straight vertical sides, and a flat top, as shown in FIG. 4. The seam gussets 30 are preferably used at both ends of a section of the pontoon 10, so that a seam gusset 30 is positioned adjacent a seam in the pontoon 10, when the pontoon 10 is manufactured in shorter sections that are affixed to one another.

A second type of gusset, the support gusset 32, has a similar shape, but the support gusset 32 does not reach all the way to the top of the pontoon, which provides an opening between the top of the support gusset 32 and the flat top panel 16, as shown in FIG. 5. The support gussets 32 are placed within the sections of the pontoon 10, and are intermittently spaced, as shown in FIG. 3, in order to provide strength and support of the V-shaped bottom 12, and of the pontoon 10 overall. Preferably, both the seam gusset 30 and the support gusset 32 also include or define a series of holes 34.

Figure 1:
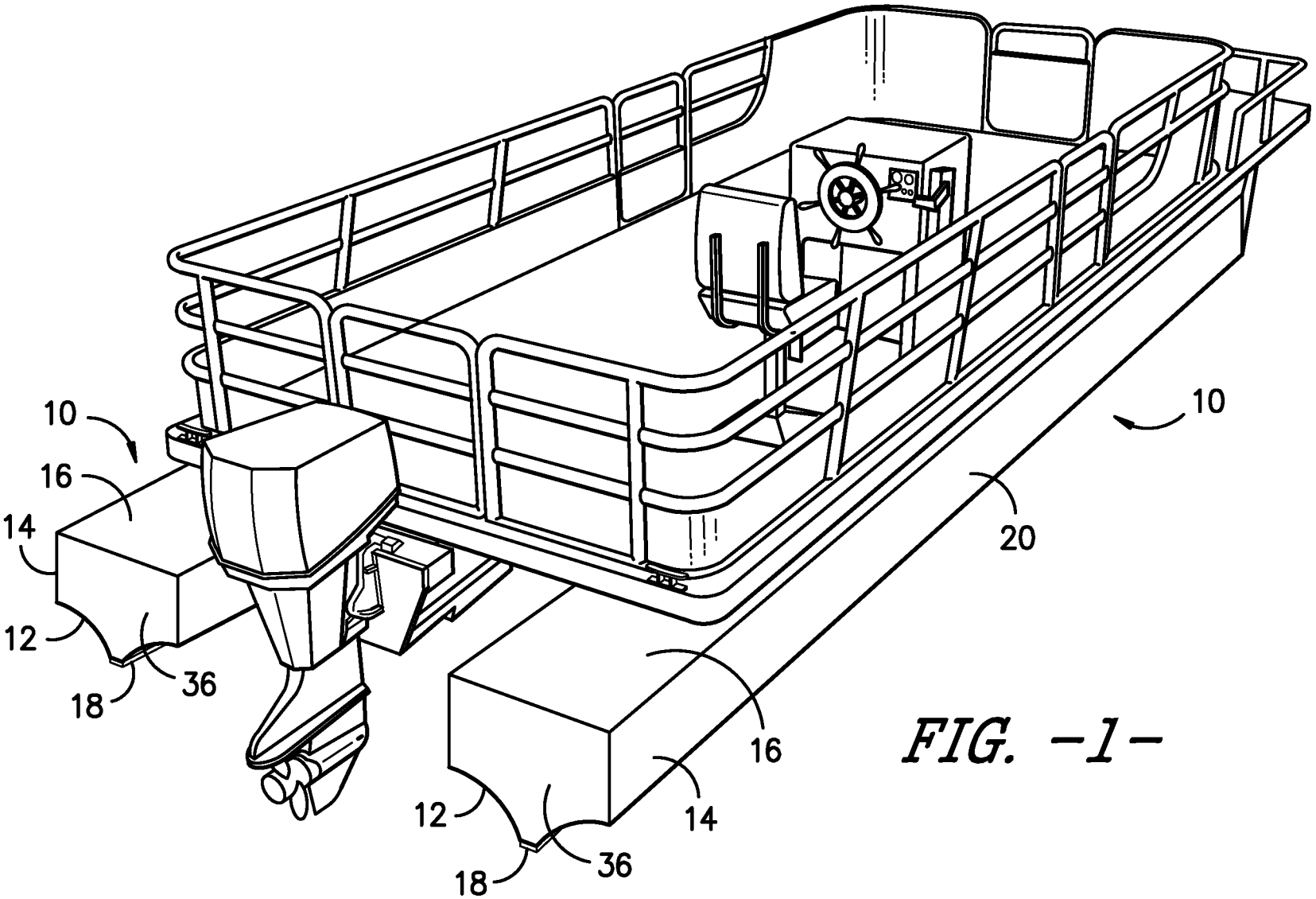
FIG. 1 is a perspective view of a pontoon boat including one embodiment of the boat pontoons having a concave V-shape on a bottom portion thereof.

In a preferred embodiment, the front section of the pontoon has a rear portion that complements or mirrors the shape of the pontoon 10, as described above, and which narrows and rises going forward to a point at the top of the pontoon 10, similarly to the shape of the bow of a V-hull fiberglass boat. The rear of the pontoon preferably includes a watertight cap 36, which mirrors the cross-sectional size and shape of the pontoon, as shown in FIGS. 1-3. Other structures may be assembled on the rear portion of the pontoon (particularly for twin-engine pontoons that include a well), as will be recognized by those skilled in the art, and as set forth in the references cited above that have been incorporated by reference herein.

The pontoons 10 are preferably welded so that they are watertight. Additionally, a buoyant foam may be blown into the interior of the pontoons, so that the foam substantially fills the interior space of the pontoons. This arrangement provides additional floatation, particularly in the event that the pontoon becomes ruptured or damaged in an accident. The holes 34 in the seam gussets 30 and the support gussets 32 allow the buoyant foam to flow therethrough. After blowing the foam into the interior of the pontoons 10, the foam is allowed to harden.

Figure 6:
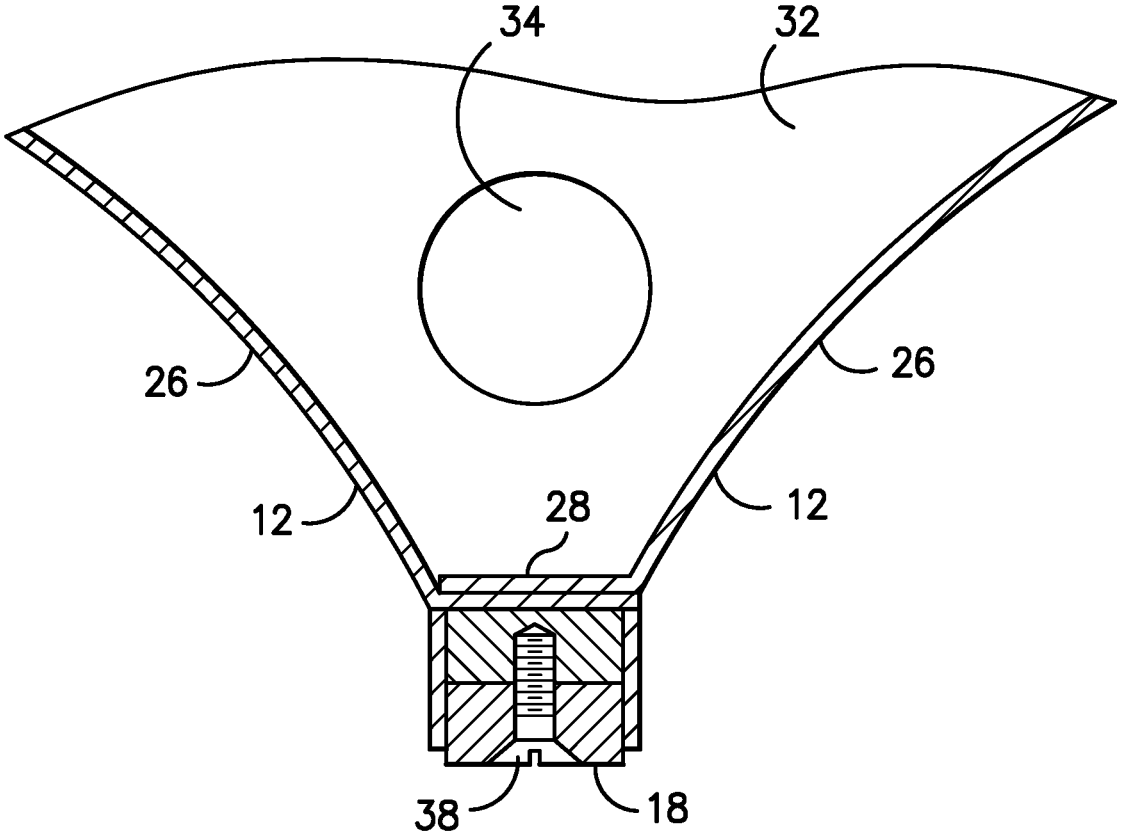
FIG. 6 is a magnified cross-sectional view of the bottom portion of a pontoon in accordance with one embodiment of the present invention, including a gusset vertically disposed on an inner portion thereof, and further including a detachable skid plate on an underside of the pontoon.

A removable and replaceable skid pad 18 may be placed on the bottom of the pontoons, as shown in FIGS. 4-6. The skid pad 18 is a longitudinal strip of tough, durable material. Any suitable material may be used for the skid pad 18, including plastics, nylon, metal or some combination thereof. Preferably, the skid pad 18 is attached by using sunken screws 38 that do not completely penetrate through the bottom of the pontoon, in order to maintain the airtight structure thereof. If a skid pad 18 becomes damaged or worn, it may simply be removed and replaced with a new one.

The flat panel 16 on the top of the pontoon 10 is advantageous because it makes attachment to a pontoon boat platform much easier, and does not require the same type of fittings that must be welded onto upper portions of pontoons having a circular cross-section. Additionally, in one embodiment, the flat top panel 16 may extend the full length of the pontoon 10, even if the rest of the pontoon 10 (right and left side members 20, 22) are made in sections. Alternatively, if the flat top panel 16 is made into sections, the seams of the flat panel may be offset from the seams attaching the right and left sections to adjacent sections, in order to provide additional strength to the pontoons 10.

Figure 7:
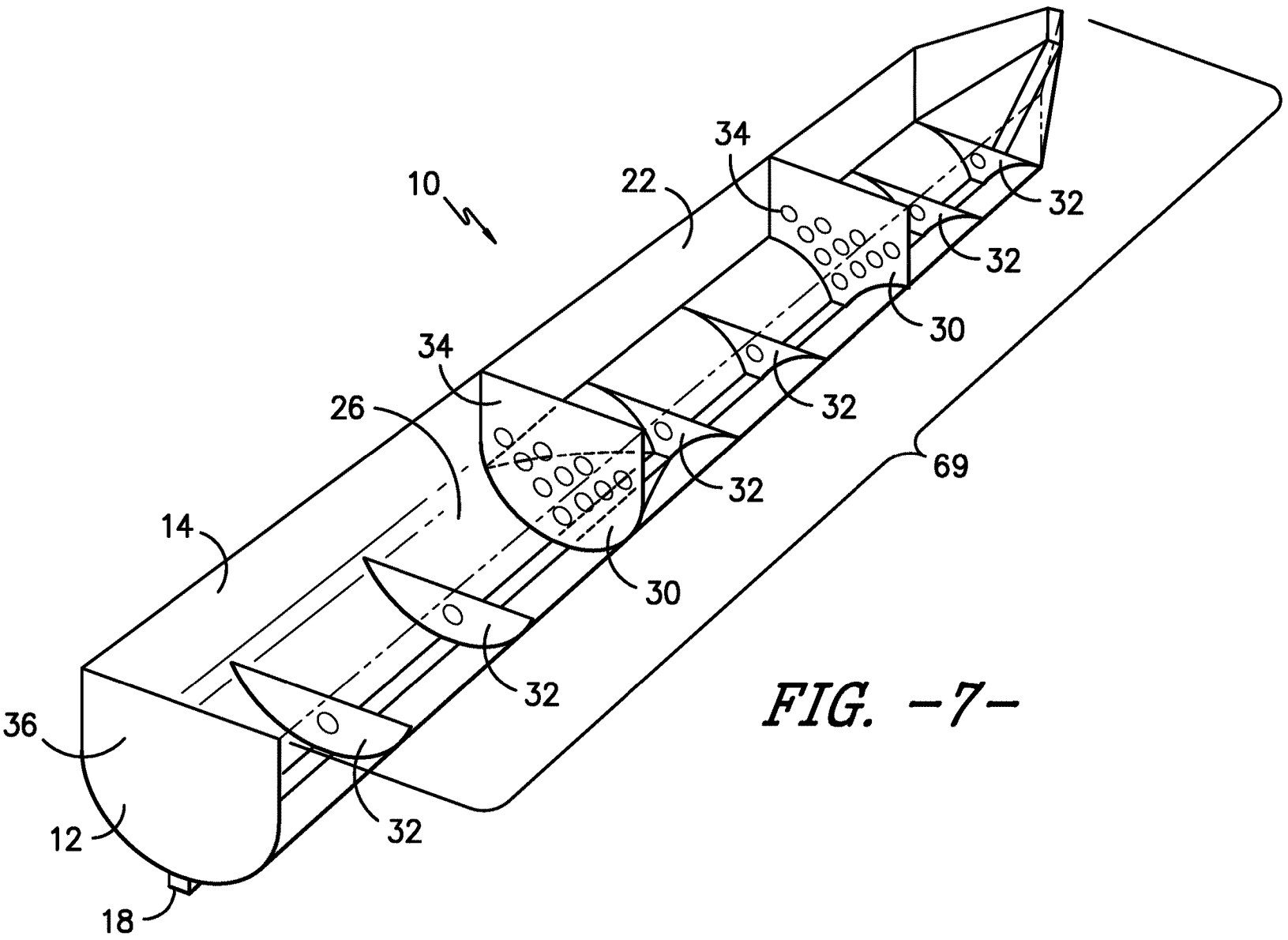
FIG. 7 is a perspective view of another embodiment of a pontoon having a concave V-shaped section on an underside of the pontoon along a front portion thereof, and having a U-shaped underside toward the rear of the pontoon.

In another embodiment, the pontoon is a longitudinal structure 69 wherein the concave V-shape on the bottom portion of the pontoon extends from a front of the pontoon to a point toward the rear of the pontoon, and then is stepped out to form a U-shape on the bottom portion thereof, near the rear of the pontoon, as shown in FIG. 7. In this embodiment, the rear U-shaped portion of the pontoon on an underside resembles a traditional pontoon, and preferably extends from the rear of the pontoon through the rear ⅓ to ½ of the pontoon, although the rear U-shaped portion may extend throughout more or less of the pontoon, as desired. This arrangement is designed to improve the turning performance of the pontoon boat, so that the rear portion of the pontoon has less resistance to lateral movement.

It is contemplated that variations on the present pontoon may be made. For instance, it is possible to manufacture the pontoon 10 from fiberglass, rather than metal. Also, it is understood that the pontoons 10 may be pressurized, if desired. Further, it is possible to produce the pontoons 10 so that the side sections and flat top panel are integrally formed longitudinal pieces, rather than being assembled in sections.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A pontoon comprising:

a generally flat top panel having a generally rectangular shape extending in a longitudinal manner and a lip along each longitudinal edge;

a pair of vertical sides, each vertical side having a top edge and a bottom edge, wherein said top edge is attached to one lip of said flat top panel;

a first bottom portion attached to said bottom edges of said vertical sides, wherein said first bottom portion forms a concave-V shape with a flat bottom and is positioned on a front section of said pontoon;

a second bottom portion of said pontoon having a U-shape, wherein said second bottom portion is positioned on a rear section of said pontoon; and a removable skid pad positioned longitudinally along said bottom portion of said pontoon.

2. The pontoon set forth in claim 1, wherein said pontoon includes a series of spaced gussets mounted vertically on an inner portion of said pontoon, wherein said gussets include a generally straight top horizontally oriented edge, two generally straight vertical sides, and a bottom gusset portion having edges corresponding with said concave-V shape of said bottom portion of said pontoon.

3. The pontoon set forth in claim 1, further including a front section that has a rear portion that is shaped to complement a cross section of said pontoon, and which extends forwardly, narrowing in width, and extending upwardly toward said flat top panel to form a V-hull shape.

4. A pontoon comprising:

a longitudinal structure having a front portion that narrows into a V-shape;

a generally flat top panel having a generally rectangular shape extending in a longitudinal manner and a lip along each longitudinal edge;

a pair of vertical sides, each vertical side having a top edge and a bottom edge, wherein said top edge is attached to one lip of said flat top panel;

a first bottom portion attached to said bottom edges of said vertical sides, wherein said first bottom portion forms a concave-V shape with a flat base and is positioned on a front section of said pontoon; and a second bottom portion of said pontoon having a U-shape, wherein said second bottom portion is positioned on a rear section of said pontoon.

5. The pontoon set forth in claim 4, wherein said pontoon includes a series of spaced gussets mounted vertically on an inner portion of said pontoon, wherein said gussets include a generally straight top horizontally oriented edge, two generally straight vertical sides, and a bottom gusset portion having edges corresponding with said concave-V shape of said first bottom portion of said pontoon in said front section of said pontoon.

6. The pontoon set forth in claim 4, wherein said pontoon includes a series of spaced gussets mounted vertically on an inner portion of said pontoon, wherein said gussets include a generally straight top horizontally oriented edge, two generally straight vertical sides, and a bottom gusset portion having edges corresponding with said U-shape of said second bottom portion of said pontoon in said rear section of said pontoon.

7. The pontoon set forth in claim 4, further including a skid pad that is attached to said flat base of said concave-V shape on said front portion of said pontoon.

8. The pontoon set forth in claim 7, wherein said skid pad is removable and replaceable.

* * * * *